US006307454B1

(12) United States Patent
Quentric

(10) Patent No.: US 6,307,454 B1
(45) Date of Patent: Oct. 23, 2001

(54) STARTING SWITCH WITH MOBILE CORE COMPRISING A DIRECTLY MOUNTED CLOSURE CUP

(75) Inventor: Jean-François Quentric, St Bonnet de Mure (FR)

(73) Assignee: Valeo Equipments Electriques Moteur (FR)

( * ) Notice: Subject to any disclaimer, the term of this patent is extended or adjusted under 35 U.S.C. 154(b) by 0 days.

(21) Appl. No.: 09/530,428

(22) PCT Filed: Sep. 3, 1999

(86) PCT No.: PCT/FR99/02101

§ 371 Date: May 1, 2000

§ 102(e) Date: May 1, 2000

(87) PCT Pub. No.: WO00/14759

PCT Pub. Date: Mar. 16, 2000

(30) Foreign Application Priority Data

Sep. 3, 1998 (FR) ..... 98 11122

(51) Int. Cl.[7] ..... H01H 67/02
(52) U.S. Cl. ..... 335/126; 335/131
(58) Field of Search ..... 335/126, 131

(56) References Cited

U.S. PATENT DOCUMENTS 4,604,597 * 8/1986 Bögner et al. ..... 335/131
4,637,267 * 1/1987 Mazzorana ..... 335/131
5,563,563 * 10/1996 Freitas et al. ..... 335/126
5,663,699 * 9/1997 Shiroyama ..... 335/126

FOREIGN PATENT DOCUMENTS 0643411 3/1995 (EP) .
2629521 10/1989 (FR) .

* cited by examiner

*Primary Examiner*—Lincoln Donovan
(74) *Attorney, Agent, or Firm*—Liniak, Berenato, Longacre & White

(57) ABSTRACT

A starter contactor for a heat engine, including a coil, in a bore of which there slides a magnetic core (32) of the type in which an external return spring (58) is in axial abutment against an external flange (56) attached to the core (32), of the type in which an internal bore (36) of the core (32) is open at its rear end (52) so as to define a rear shoulder surface (42) for abutment of an internal return spring (38) for a coupling rod (26) of a lever for actuating an actuator pinion, which rod (26) passes through the rear end (52) of the core (32), and is able to bear on a front base (48) of the bore (36) so as to be displaced by the core (32), characterised in that the front base (48) is integral with the core (36), and in that a capping piece (54) attached to the rear end (52) includes the rear shoulder surface (42) of the bore (36) and the external flange (56).

9 Claims, 3 Drawing Sheets

STARTING SWITCH WITH MOBILE CORE COMPRISING A DIRECTLY MOUNTED CLOSURE CUP

BACKGROUND OF THE INVENTION

1. Field of the Invention

This invention relates to an electromagnetic actuator for an actuating head of a motor vehicle starter, also referred to as a starter contactor.

2. Description of Related Art

More particularly, the invention relates to a contactor for a starter of a combustion engine, especially for a motor vehicle, of the type comprising an annular coil which surrounds a cylindrical magnetic core mounted for axial sliding movement in a bore of the coil, of the type in which a rear portion of the movable core projects axially outside the fixed coil, of the type in which an external return spring for the movable magnetic core is in axial engagement against an external radial flange carried by the rear portion of the movable magnetic core and the body of the coil, of the type in which the movable magnetic core has an internal bore which is open at its rear end and which enables a coupling rod to pass through, the rear end of the coupling rod being coupled to a lever for actuating the actuator pinion which is urged elastically towards the front of the bore by an internal spring mounted in axial compression and engaged between a front shoulder surface of the coupling rod and a rear shoulder surface of the movable magnetic core, and which is arranged to engage on a base element at the front of the bore so as to be driven in straight line movement by the movable magnetic core of the starter.

In a known way, the magnetic field created by the electrical conductor wound around the body of the coil of a contactor follows lines of force which are substantially axial within the coil, and which are in the form of loops closed on themselves outside the coil.

In accordance with a known design, the movable magnetic core is generally a piece of soft iron which, whatever may be its axial position in the bore of the coil, ensures continuity of passage for magnetic flux between the carcass and the movable magnetic core. Thus, the lines of force are closed on themselves in the immediate vicinity of the coil, which enables the output of the electromagnet to be increased and the electric power consumed by the latter to be reduced.

Conventionally, the movable magnetic core is formed by a turning operation, because it has complex forms such as a rear shoulder surface of the bore of the movable magnetic core, formed internally and providing an abutment for the internal spring of the control rod, or such as a front surface formed at the base of the bore of the movable magnetic core and arranged to receive a front plate, which closes off the bore of the movable magnetic core after the components have been assembled within the bore.

This type of manufacture renders the component costly in the context of high quantity production.

In a known design, it has previously been proposed to apply to the rear face of the movable magnetic core a capping piece which includes an external flange, which is attached in such a way as to simplify the profiles of the movable magnetic core. This design, although it does partly simplify the movable magnetic core, does however not enable the rear shoulder surface of the bore of the movable magnetic core and the front surface which is to receive the closure plate to be made by any method other than by a turning operation, and the manufacture of the movable magnetic core remains expensive, the external flange not having a form which can be made by turning, so that it must be, and preferably is, an attached component.

SUMMARY OF THE INVENTION

In order to simplify the profiles of the movable magnetic core, and to enable another and less expensive manufacturing method to be used, such as extrusion, the invention proposes a movable magnetic core which includes a rear shoulder surface of the bore of the movable magnetic core which is simplified, and which also includes simplified closure of the base of the bore.

With this in view, the invention proposes a contactor for a starter of a heat engine, especially for a motor vehicle, of the type comprising an annular coil which surrounds a cylindrical magnetic core mounted for axial sliding movement in a bore of the coil, of the type in which a rear portion of the movable magnetic core projects axially outside the fixed coil, of the type in which an external return spring for the movable magnetic core is in axial engagement against an external radial flange carried by the rear portion of the movable magnetic core, of the type in which the movable magnetic core has an internal bore which is open at the rear end, disposed in front of the flange, and which enables a coupling rod to pass through, the rear end of the coupling rod being coupled to a lever for actuating the actuator pinion which is urged elastically towards the front of the bore by an internal spring mounted in axial compression against a front shoulder surface of the coupling rod and a rear shoulder surface of the movable magnetic core, the front end of the coupling rod being arranged to engage on a base element at the front of the bore so as to be driven in straight line movement by the movable magnetic core of the starter, characterised in that the front base element of the bore is formed integrally with the body of the movable magnetic core, and in that a capping piece attached to the rear end of the movable magnetic core includes the rear shoulder surface of the bore of the movable magnetic core and the external flange.

In accordance with other features of the invention:

- the external flange is arranged at the rear end of the capping piece, and the shoulder surface of the bore of the movable magnetic core constitutes a front base element of the capping piece, which is pierced for passage of the coupling rod through it, and which is in axial forward abutment against the rear end face of the body of the core;
- the external diameter of the body of the capping piece is substantially equal to the diameter of the body of the movable magnetic core, so that the capping piece extends, axially towards the rear, the body of the movable magnetic core;
- the front base of the capping piece is welded to the rear end of the body of the movable magnetic core;
- the capping piece has at least two arms extending axially forward beyond the front base of the capping piece and facing the periphery of the movable magnetic core;
- the arms include at their front ends bends which are bent back radially towards the axis of the movable magnetic core;
- the arms are cut out in the front base of the capping piece and are bent back at right angles;
- the capping piece is seamed on the movable magnetic core by axial upsetting of the material of the rear end of the body of the movable magnetic core, so as to form a peripheral bead located axially between the rear end of the body of the movable magnetic core and the bends in the arms, whereby to immobilise the arms axially;

the bends of the arms are attached by radial insertion in a groove formed in the periphery of the body of the movable magnetic core;

the capping piece is seamed on the movable magnetic core by axial upsetting of the material of the periphery of the movable magnetic core, which causes radial outward flow of material into facing holes which are formed in the arms.

BRIEF DESCRIPTION OF THE DRAWINGS

Further features and advantages of the invention will appear on a reading of the following detailed description, for an understanding of which, reference will be made to the attached drawings, in which.

DETAILED DESCRIPTION OF PREFERRED EMBODIMENTS

In the following description, identical reference signs designate components which are identical or which have similar functions to each other.

Figure 1:
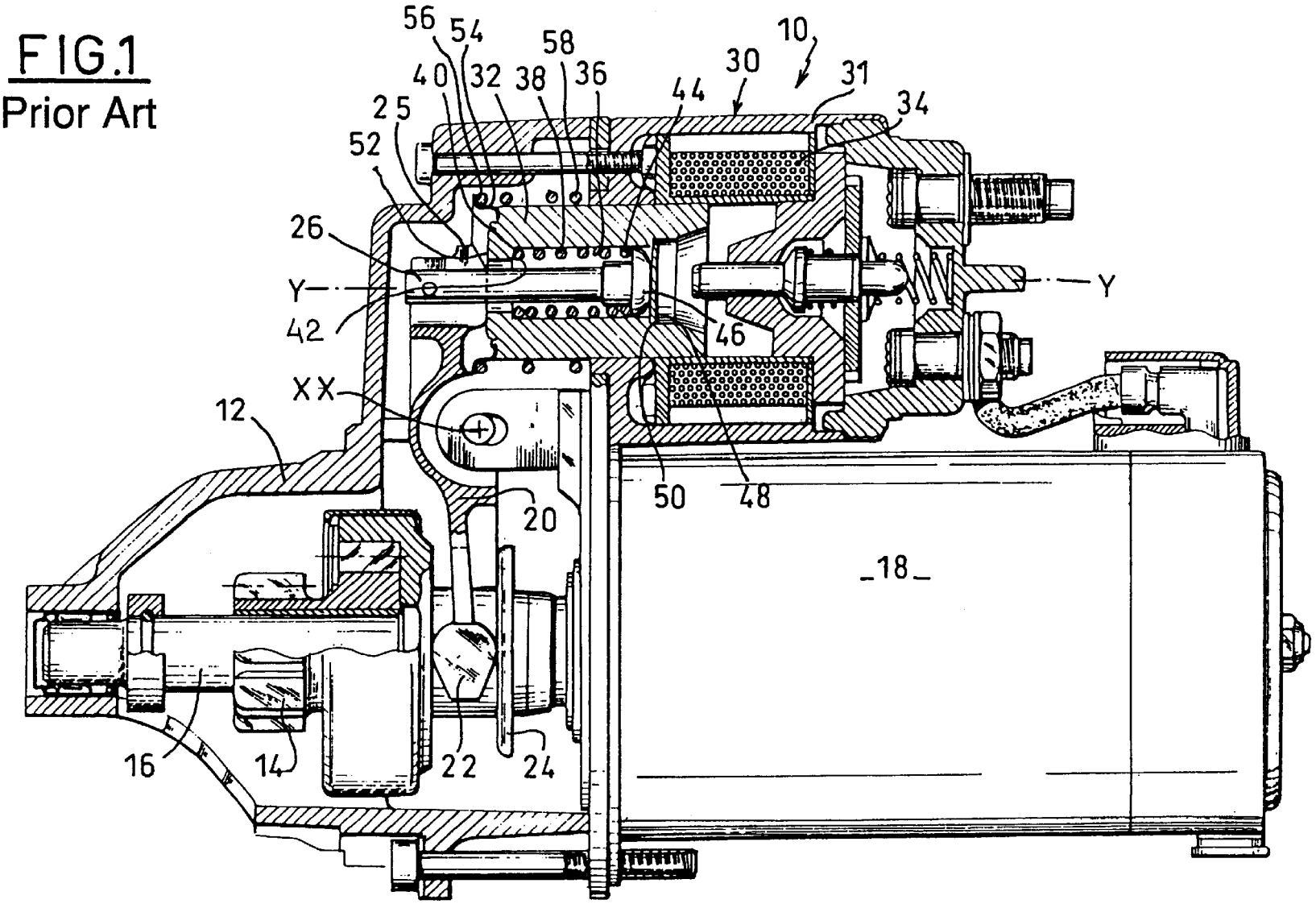
FIG.1 Prior Art
FIG. 1 is a view in axial cross section of a starter which includes a contactor in accordance with the state of the art.

FIG. 1 shows a starter 10 for a motor vehicle combustion engine (not shown). The starter 10 consists essentially of a casing 12, within which an actuator pinion 14, which is mounted for sliding movement on one end of a shaft 16, is arranged. The shaft 16 is driven in rotation by an electric motor 18 of the starter 10.

The sliding movements of the actuator pinion 14 are caused by a lever or fork 20 which pivots within the casing 12 about a horizontal geometric axis X—X.

The free lower end 22 of the control lever 20 acts on an element 24 for driving the actuator pinion 14, while its free upper end 25 is connected to a coupling rod 26 which is part of an electromagnetic contactor 30 arranged in the upper part of the starter 10.

In accordance with a known design, the contactor 30 includes a movable magnetic core 32, the displacements of which are controlled by a coil 34 along a horizontal axis Y—Y at right angles to the axis X—X of pivoting movement of the lever 20.

The movable magnetic core 32 is a component which is generally of hollow annular cylindrical form, and which is guided in sliding movement by its outer cylindrical surface, the coupling rod 26 and a helical compression spring 38 being received within its internal bore 36.

The rear end 40 of the spring 38 bears against a rear shoulder surface 42 of the bore 36 of the movable magnetic core 32, while the front end 44 of the spring 38 bears against a front shoulder surface of the coupling rod 26, carried by a head 46 which is arranged at the free front end of the coupling rod 26.

In addition, the coupling rod 26 is arranged to bear, through its head 46, on a front base element which consists of a disc in the form of a plate which closes off the bore 36, this plate being seamed in a cylindrical seating 50 of the movable magnetic core 32, the coupling rod 26 being able to be driven in straight line movement along the axis Y—Y and towards the rear, by the movable magnetic core 32 during the actuation or release of the electromagnet which consists of the movable magnetic core 32 and coil 34.

In the state of the art, the rear annular shoulder surface 42 is formed integrally with the body of the movable magnetic core 32, while the rear end 52 of the movable magnetic core 32, which extends axially towards the rear and projects out of the fixed coil 34, includes an attached capping piece 54, which is seamed on the rear end 52 of the movable magnetic core 32, and which includes at its periphery a flange 56 which extends radially outwards and which is adapted to serve as an abutment for an external return spring 58, which biases the movable magnetic core 32 towards its rear or rest position shown in FIG. 1. In this connection, the spring 58 urges the movable magnetic core 32 elastically towards the rear by bearing between the flange 56 and the carcass 31 of the contactor 30.

Figure 2:
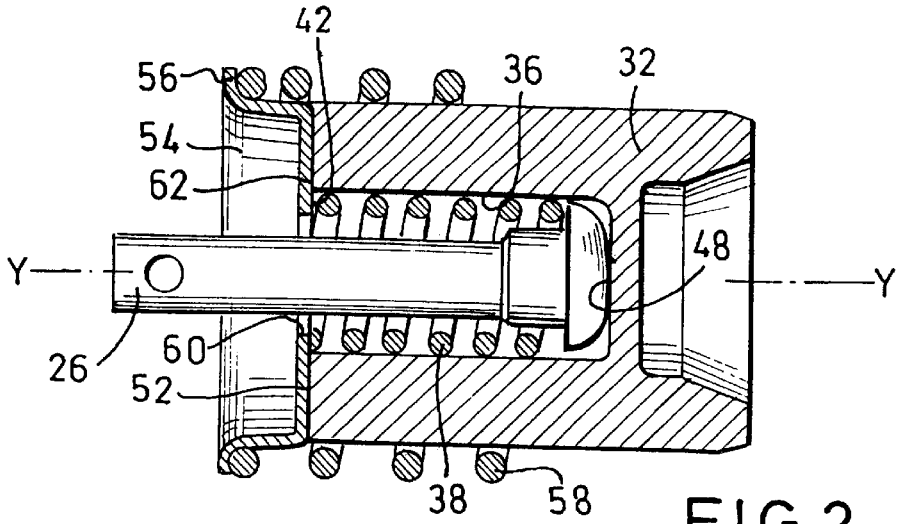
FIG. 2 is a view in axial cross section of a movable magnetic core on which a capping piece in a first embodiment of the invention is welded.

FIG. 2 shows a first embodiment of the invention, in which a novel attached capping piece 54 is arranged at the rear end 52 of the movable magnetic core 32.

The movable magnetic core 32 is substantially different from the movable magnetic core described above with reference to FIG. 1, in that the bore 36 of the movable core 32 is open at the rear end of the movable magnetic core 32 and is blind at the front end.

Thus, the front base portion 48 of the bore 36 no longer consists of an attached disc as described above with reference to the state of the art, but is formed integrally with the body of the movable magnetic core 32.

The tubular body of the attached capping piece 54 has an external diameter which is substantially equal to the diameter of the movable magnetic core 32, and it includes at its rear end the flange 56 described above with reference to FIG. 1.

The bore 36 no longer has the rear annular internal face as described above with reference to FIG. 1, but it is open in the free annular rear end face 52 of the core 32.

The radial rear shoulder of the bore 36 of the movable magnetic core 32 consists of a base portion 62 of the capping piece 54, which has a central hole 60 the diameter of which is greater than the diameter of the coupling rod 26, and which enables the coupling rod 26 to perform axial and vertical displacements when the rear end of the latter is displaced with the end 25 of the actuating lever 20.

The central portion of the base 62 of the capping piece 54, which extends radially inwards, facing into the bore 36, defines the annular rear shoulder surface 42 on which the internal return spring 38 for the coupling rod 26 bears.

It is therefore only the capping piece 54 that has the two surfaces 56 and 42 on which the external return spring 58 for the movable magnetic core 32, and the internal return spring 38 for the coupling rod 26, are engaged.

Preferably, in this embodiment the capping piece 54 is welded in the region of the periphery of its base 62 to the periphery of the rear end 52 of the movable magnetic core 32.

In another version, the base 62 of the capping piece 54 may be assembled by spot welding or by adhesive bonding to the rear end 52 of the movable magnetic core 32.

Figure 3:
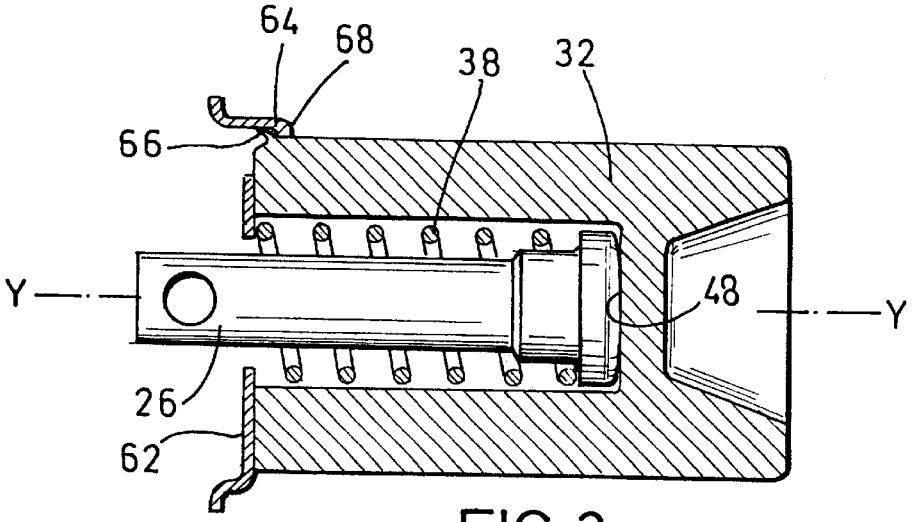
FIG. 3 is a view in axial cross section of a movable magnetic core on which a capping piece in a second embodiment of the invention is seamed.

FIG. 3 shows a second embodiment in which the capping piece 54 is seamed to the rear end 52 of the movable magnetic core 32.

The capping piece 54 has a general form which is similar to that described with reference to FIG. 2. In this second embodiment of the invention, the tubular body of the capping piece 54 has a diameter which is slightly greater than the external diameter of the movable magnetic core 32, and it preferably includes three arms 64, spaced apart circumferentially at regular intervals, which extend axially forward in such a way that they are adjacent to the periphery of the movable magnetic core 32. The arms 64 include, at their front ends, bends 68 the function of which is to provided centring for the capping piece 54 on the body of the movable core 32.

The capping piece 54 may with advantage be, for example, made by stamping.

In another version, the capping piece 54 can be made by being formed from a capping piece 54 similar to that which is described with reference to FIG. 2, in the base 62 of which three flat radial lugs are stamped out, these lugs being subsequently bent back at right angles and in the axial direction Y—Y to the base 62, so as to constitute the arms 64 which extend axially forward.

During assembly, the capping piece 54 is fitted over the rear end 52 of the movable magnetic core 32 until the base 62 of the capping piece 64 is in axial abutment against the rear end 52 of the movable magnetic core 32. Preferably, the rear end 52 of the movable magnetic core 32 constitutes an axial forward abutment for the capping piece 54.

Figure 4:
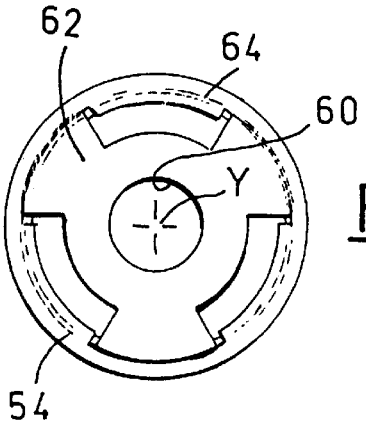
FIG. 4 is a view taken from FIG. 3 and showing in an axially directed rear view a capping piece in the second embodiment of the invention.
Figure 5:
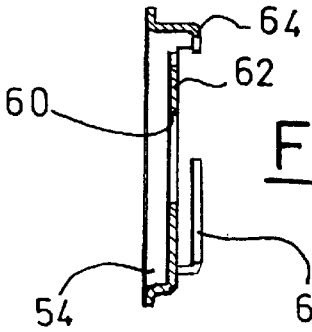
FIG. 5 is a view in axial cross section of the capping piece of FIG. 4.

In addition, the capping piece 54 is simultaneously held externally so that it cannot be deformed radially outwards. A seaming tool then penetrates axially along the axis Y—Y into the interior of the capping piece 54 in the spaces which are left free when the arms 64 are stamped out, which can be seen more particularly in FIG. 4, and the tool upsets the end 52 of the movable magnetic core so as to form, facing the arms 64 of the capping piece 54, an axial bead 66 in the material of the movable magnetic core 32, which holds the arms 64 of the capping piece 54 against rearward axial movement with respect to the movable magnetic core 32. The capping piece 54 is also held against forward axial movement by means of its base 62, in engagement on the rear end 52 of the movable magnetic core 32, so that it is rigidly coupled to the movable magnetic core 32.

Figure 6:
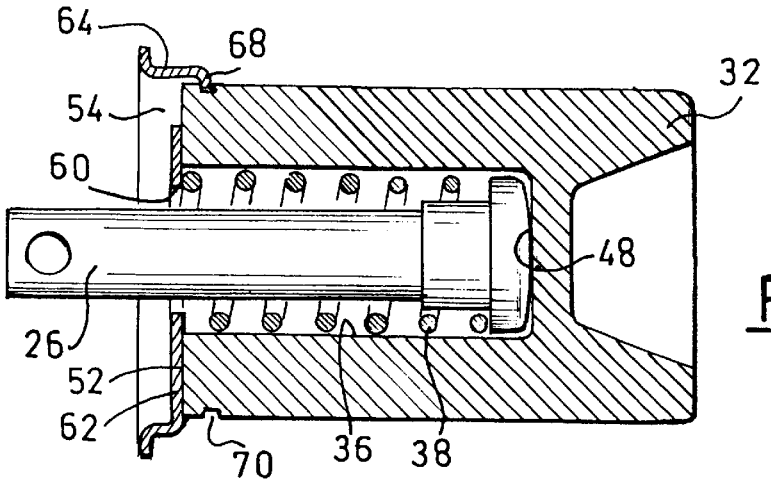
FIG. 6 is a view in axial cross section of a movable magnetic core on which a capping piece in a third embodiment of the invention is attached by insertion.
Figure 7:
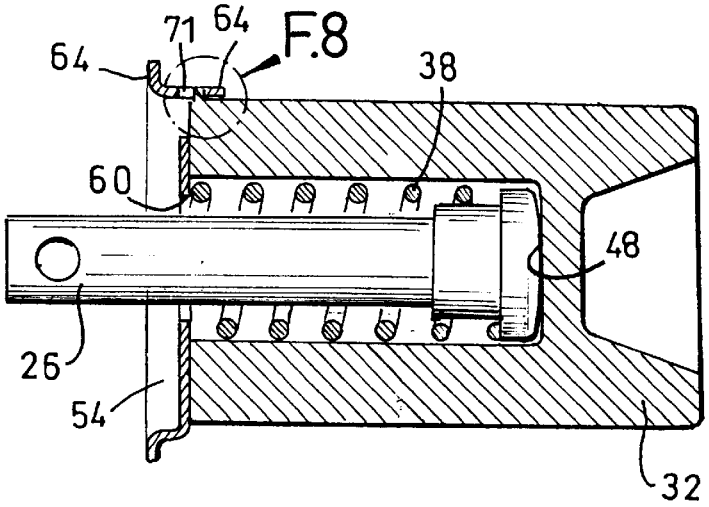
FIG. 7 is a view in cross section taken on the line 7—7 in FIG. 9, showing a movable magnetic core on which a capping piece in a fourth embodiment of the invention is seamed.
Figure 8:
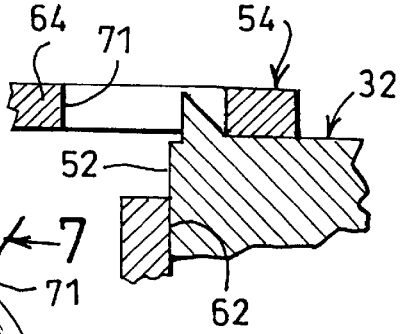
FIG. 8 shows the detail indicated at F8 in FIG. 7, representing the fastening of the arms of the capping piece on the movable magnetic core.

FIG. 6 shows a third embodiment in which the capping piece 54 is not seamed, but is attached by forced insertion on the rear end 52 of the movable magnetic core 32. The capping piece 54 is substantially similar to the capping piece 54 described with reference to FIG. 3, and it is provided with three arms 64 which are spaced apart circumferentially at regular intervals, and which extend axially forward into contact with the periphery of the movable magnetic core 32. The arms 64 include, at their front end, bends 68 which are bent back radially towards the axis Y—Y of the movable magnetic core 32, and which in this embodiment are arranged to be received within an external radial groove 70 formed at the periphery of the movable magnetic core 32.

Accordingly, and as can be seen in FIG. 6, during assembly of the capping piece 54 on the movable magnetic core 32, the capping piece 54 is threaded axially over the movable magnetic core 32, temporarily deforming the arms 64 outwards, after which the bends 68 of the arms 64 of the capping piece 54 penetrate into the groove 70 of the movable magnetic core 32, thus ensuring that it is held against axial movement, with the base 62 of the capping piece 54 coming into contact with the rear end 52 of the movable magnetic core 32, in order to complete the axial immobilisation of the capping piece 54 and to determine a precise axial position of the capping piece 54 with respect to the core 32.

FIGS. 7 to 10 illustrate a fourth embodiment, in which the capping piece includes two diametrically opposed axial arms which are secured to the movable magnetic core 32.

Figure 9:
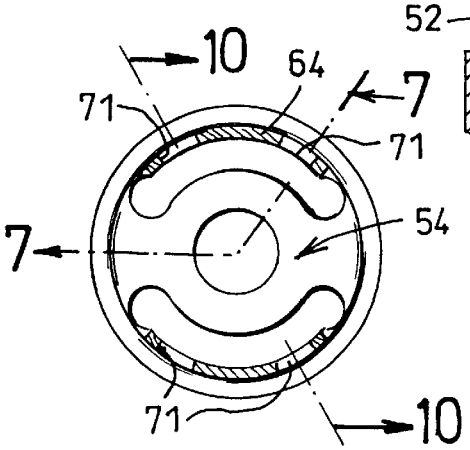
FIG. 9 is a view taken on the line 9—9 in FIG. 10, showing in an axially directed rear view the capping piece shown in FIG. 7.
Figure 10:
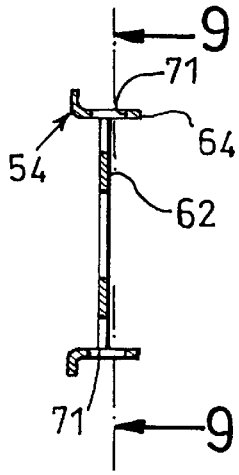
FIG. 10 is a view, in axial cross section taken on the line 10—10 in FIG. 9, of the capping piece shown in FIG. 7.

As is shown in FIGS. 9 and 10, the capping piece 54 has two arms 64 which extend axially forward and which are substantially in the form of a circular arc in a transverse plane at right angles to the axis Y—Y. Each of the arms 64 has two holes 71 situated in the same transverse plane, which are arranged to cooperate with the body of the movable magnetic core 32 during the seaming operation, so as to immobilise the capping piece 54 against movement with respect to the movable magnetic core 32.

The capping piece 54 may for example be a press-formed component, or may be formed by stamping and bending, the arms 64 being cut out beforehand in the base 62 of the capping piece 54 and then bent back at right angles to the latter so that, once the capping piece 54 is in position on the movable magnetic core 32, the arms extend radially forwards, to follow the periphery of the movable magnetic core 32.

During assembly of the capping piece 54 on the movable magnetic core 32, the capping piece 54 is threaded axially over the movable magnetic core 32 until its base 62 is in abutment on the rear end 52 of the movable magnetic core 32.

The capping piece 54 is held by its outer periphery in an appropriate jig, to prevent it from being deformed during the seaming operation. A seaming tool is then introduced into the interior of the concavity of the capping piece 54, in the interstices which are left free by cutting out the arms 64, and it upsets the rear end 52 of the movable magnetic core 32 in such a way that the material of the movable magnetic core 32 is displaced radially outwards and penetrates into the holes 72 of the capping piece 54, retaining it against rearward axial movement, in the manner that is shown in the detail view of FIG. 8.

The various movable magnetic cores of the contactor 30, made in these ways, have the advantage that they significantly reduce production costs.

What is claimed is:

1. A contractor (30) for a starter (10) of a combustion engine, comprising an annular fixed coil (34) which surrounds a cylindrical magnetic core (32) mounted for axial sliding movement in a bore of the fixed coil (34), in which a rear portion of the movable magnetic core (32) projects axially outside the fixed coil (34), in which an external return spring (58) for the movable magnetic core is in axial engagement against an external radial flange (56) carried by the rear portion of the movable magnetic core (32), in which the movable magnetic core (32) has an internal bore (36) which is open at a rear end (52), disposed in front of the flange (56), and in which a rear end of a coupling rod (26) having a front end passes through, the rear end of the coupling rod being coupled to a lever (20) for actuating an actuator pinion (14) which is urged elastically towards the front of the bore (36) by an internal spring (38) mounted in axial compression against a front shoulder surface of the coupling rod (26) and a rear shoulder surface (42) of the movable magnetic core (32), the front end of the coupling rod being arranged to engage on a base element (48) at the front of the bore so as to be driven in straight line movement by the movable magnetic core (32) of the starter, characterized in that the base element (48) of the bore (36) is formed integrally with the body of the movable magnetic core (32), in that a capping piece (54) attached to the rear end (52) of the movable magnetic core (32) includes the rear shoulder surface (42) of the bore (36) of the movable magnetic core (32) and the external flange (56) and in that external flange (56) is arranged at the rear end of the capping piece (54), and in that the shoulder surface (42) of the bore of the movable magnetic core (32) constitutes a front base element (62) of the capping piece (54), which is pierced for passage of the coupling rod (26) through it, and which is in axial forward abutment against the rear end face of the body of the core.

2. A contactor (30) for a starter (10) according to claim 1, characterized in that the external diameter of the body of the capping piece (54) is equal to the diameter of the body of the movable magnetic core (32), so that the capping piece (54) extends, axially towards the rear, the body of the movable magnetic core (32).

3. A contactor (30) for a starter (10) according to claim 1, characterized in that the capping piece (54) has a frond base (62) welded to the rear end (52) of the body of the movable magnetic core (32).

4. A contactor (30) for a starter (10) according to claim 1, characterized in that the capping piece (54) has a front base (62) and at least two arms (64) extending axially forward beyond the front base (62) of the capping piece (54) and facing the periphery of the movable magnetic core (32).

5. A contactor (30) for a starter (10) according to claim 3, characterized in that the arms (64) include bends (68) which are bent back radially towards the axis of the movable magnetic core (32).

6. A contactor (30) for a starter (10) according to claim 3 or claim 5, characterized in that the arms (64) are cut out in the front base (62) of the capping piece (54) and are bent back at right angles.

7. A contactor (30) for a starter (10) according to claim 4, characterized in that the capping piece (54) is seamed on the movable magnetic core (32) by axial upsetting of the material of the rear end (52) of the body of the movable magnetic core, so as to form a peripheral bead (66) located axially between the rear end (52) of the body of the movable magnetic core (32) and the bends (68) in the arms (64), wherein the peripheral head (66) immobilizes the arms (64) axially.

8. A contactor (30) for a starter (10) according to claim 4, characterized in that the bends (68) of the arms (64) are attached by radial insertion in a groove (70) formed in the periphery of the body of the movable magnetic core (32).

9. A contactor (30) for a starter (10) according to claim 4, characterized in that the capping piece (54) is seamed on the movable magnetic core (32) by axial upsetting of the material of the periphery of the movable magnetic core (32), which causes radial outward flow of material into facing holes (71) which are formed in the arms (64).

* * * * *